US010893786B2

(12) United States Patent
Quintero et al.

(10) Patent No.: US 10,893,786 B2
(45) Date of Patent: Jan. 19, 2021

(54) PORTABLE EXTRACTOR

(71) Applicant: TTI (Macao Commercial Offshore) Limited, Macau (CN)

(72) Inventors: Juan Aviles Quintero, Huntersville, NC (US); Israel Del Toro, Charlotte, NC (US); Mohammed Irfan, Huntersville, NC (US); Donovan Bode, Charlotte, NC (US); Douglas M. Rukavina, Concord, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 16/577,136

(22) Filed: Sep. 20, 2019

(65) Prior Publication Data

US 2020/0093343 A1 Mar. 26, 2020

Related U.S. Application Data

(60) Provisional application No. 62/734,760, filed on Sep. 21, 2018.

(51) Int. Cl.
*A47L 11/30* (2006.01)
*A47L 11/40* (2006.01)

(52) U.S. Cl.
CPC ..... *A47L 11/30* (2013.01); *A47L 11/4016* (2013.01); *A47L 11/4083* (2013.01); *A47L 11/4088* (2013.01)

(58) Field of Classification Search
CPC .. A47L 11/30; A47L 11/4016; A47L 11/4083; A47L 11/4088; A47L 11/4075; A47L 11/4005
IPC ..... A47L 11/40
See application file for complete search history.

(56) References Cited

U.S. PATENT DOCUMENTS

| | | | |
|---|---|---|---|
| D496,764 | S | 9/2004 | Lopano |
| 7,073,226 | B1 | 7/2006 | Lenkiewicz et al. |
| D536,147 | S | 1/2007 | Medema et al. |
| D537,216 | S | 2/2007 | Davis et al. |
| D585,608 | S | 1/2009 | Conrad et al. |

(Continued)

FOREIGN PATENT DOCUMENTS

| | | | |
|---|---|---|---|
| CN | 302372820 | S | 3/2013 |
| CN | 302808974 | S | 4/2014 |

(Continued)

OTHER PUBLICATIONS

Patent Cooperation Treaty Invitation to Pay Additional Fees for Application No. PCT/US2019/052098 dated Dec. 5, 2019 (10 pages).

(Continued)

*Primary Examiner* — David Redding
(74) *Attorney, Agent, or Firm* — Michael Best & Friedrich LLP

(57) ABSTRACT

A portable extractor includes a supply tank, a recovery tank, a pump in fluid communication with the supply tank, a suction source in fluid communication with the recovery tank, a base configured to support the suction source and the pump, and a main housing mounted on the base and housing the suction source and the pump. The main housing is configured to removably support the recovery tank and the supply tank. The recovery tank is arranged at a front side of the portable extractor and the supply tank is arranged at a lateral side of the portable extractor between the front side and the rear side.

16 Claims, 17 Drawing Sheets

(56) References Cited

U.S. PATENT DOCUMENTS

| | | | |
|---|---|---|---|
| D595,910 | S | 7/2009 | Hollis et al. |
| D659,309 | S | 5/2012 | Benacquisto et al. |
| D660,531 | S | 5/2012 | Benacquisto |
| D675,796 | S | 2/2013 | Benacquisto et al. |
| 2005/0091783 | A1 | 5/2005 | Sepke et al. |

FOREIGN PATENT DOCUMENTS

| | | | |
|---|---|---|---|
| CN | 105662289 | A | 6/2016 |
| CN | 304014514 | S | 1/2017 |
| EM | 0000846852-0004 | | 2/2008 |
| EM | 000846852-0005 | | 2/2008 |
| GB | 2406784 | A | 4/2005 |
| WO | DM096008-1 | | 5/2017 |

OTHER PUBLICATIONS

International Search Report and Written Opinion for Application No. PCT/US2019/052098 dated Feb. 3, 2020 (17 pages).

PORTABLE EXTRACTOR

CROSS-REFERENCE TO RELATED APPLICATIONS

This application claims priority to U.S. Provisional Patent Application No. 62/734,760, filed Sep. 21, 2018, the entire contents of which are hereby incorporated by reference herein.

BACKGROUND

The present disclosure relates to a cleaning apparatus, and more specifically to a portable extractor-type cleaning apparatus.

An extraction cleaner, such as an upright extractor or a canister extractor, typically dispenses cleaning fluid from a supply tank onto a surface, for example carpet, upholstery, or a hard floor, to clean the surface. The extraction cleaner then draws the cleaning fluid along with dirt from the surface into a recovery tank, leaving the surface relatively clean. It may also be possible to deliver water from the supply tank to the surface to rinse the surface before and/or after the cleaning fluid is applied.

SUMMARY

In some embodiments, the present disclosure relates to a portable extraction cleaner. The portable extraction cleaner includes a supply tank for holding a cleaning liquid and a recovery tank for receiving and storing a recovered liquid and dirt. The portable extraction cleaner also includes a pump in fluid communication with the supply tank and operable to supply the cleaning liquid from the supply tank, and a suction source in fluid communication with the recovery tank and operable to draw the recovered liquid and dirt into the recovery tank. Further, the portable extraction cleaner includes a base configured to support the suction source and the pump and a main housing mounted on the base and housing the suction source and the pump. The main housing configured to removably support the recovery tank and the supply tank. The recovery tank is arranged at a front side of the portable extraction cleaner when supported by main housing and the supply tank is arranged at a lateral side of the portable extraction cleaner between the front side and the rear side when supported by main housing.

In some embodiments, the present disclosure relates to a portable extraction cleaner. The portable extraction cleaner includes a main housing and a recovery tank supported by the main housing. The recovery tank has portions at least partially defining a front side and a top side of the portable extraction cleaner. The portable extraction cleaner also includes a supply tank spaced rearwardly of the recovery tank and supported by the main housing. The supply tank has portions that at least partially defining at least one of the top side and a first lateral side of the portable extraction cleaner. In addition, the portable extraction cleaner includes a battery pack spaced rearwardly of the supply tank and supported by the main housing at a rear side of the portable extraction cleaner opposite the front side.

In some embodiments, the present disclosure relates to a portable extraction cleaner. The portable extraction cleaner includes a main housing including a housing body that defines a front portion having an upwardly facing horizontal platform positioned at a lower end of the front portion. The portable extraction cleaner also includes a recovery tank removably supported on the platform in a vertical orientation, the recovery tank having portions at least partially defining a front side and a top side of the portable extraction cleaner. In addition, the portable extraction cleaner includes a battery pack supported by the main housing at a rear portion of the housing body opposite the front portion.

Other features and advantages of the present disclosure will become apparent by consideration of the following description and the appended claims when taken in connection with the accompanying drawings.

DETAILED DESCRIPTION

Figure 1:
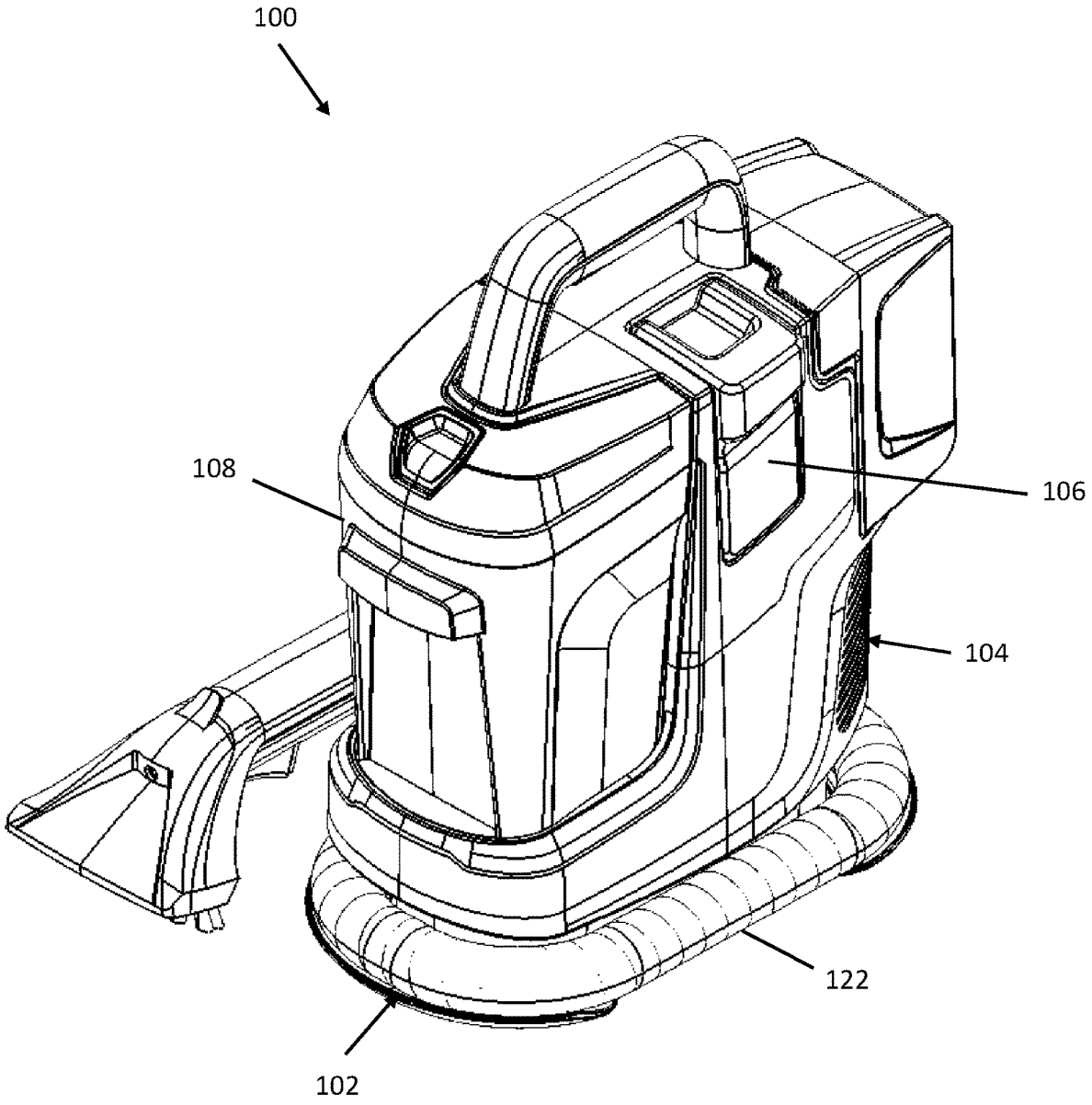
FIG. 1 is a perspective view of a portable extraction cleaner in accordance with an embodiment of the present disclosure.
Figure 2:
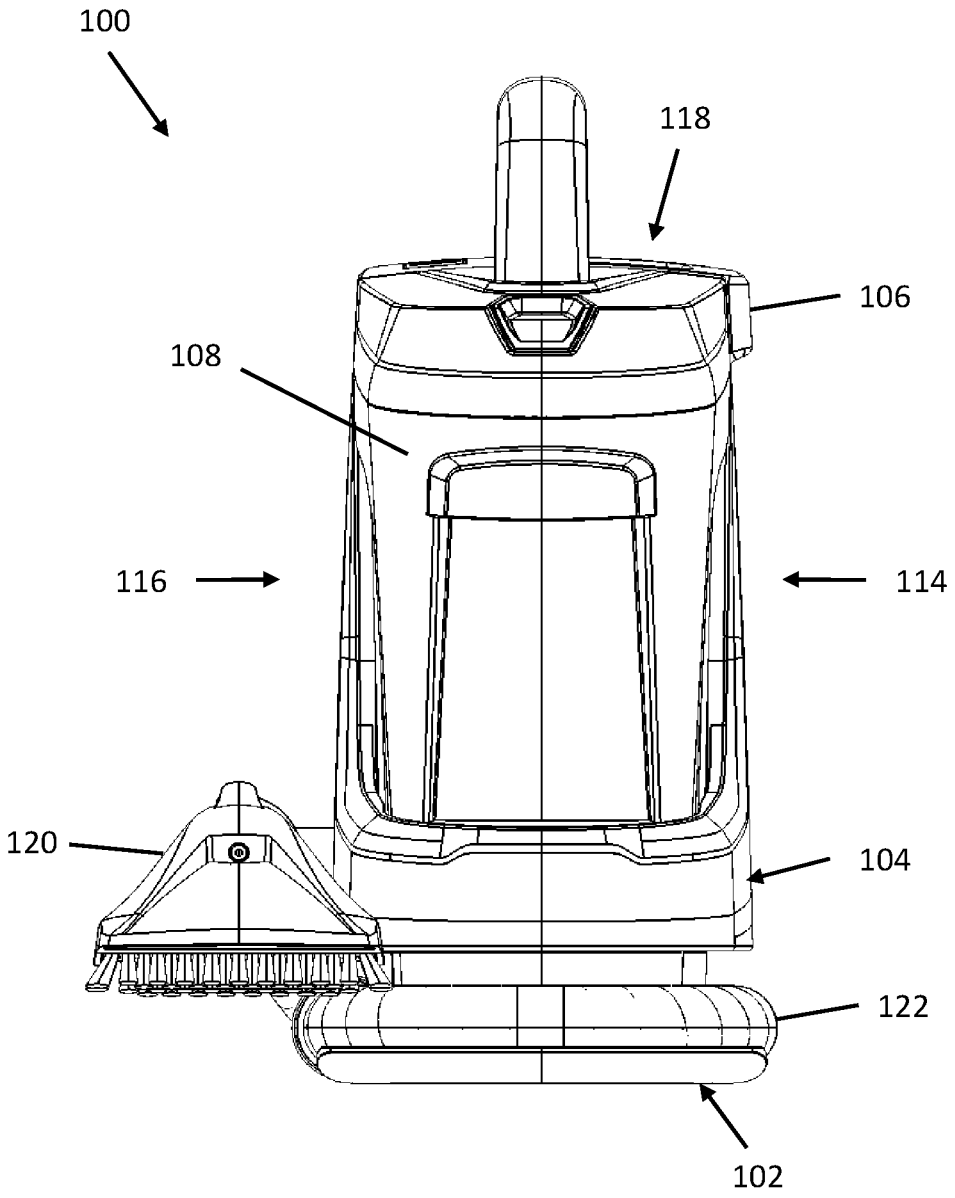
FIG. 2 is a front side elevational view of the portable extraction cleaner of FIG. 1.
Figure 3:
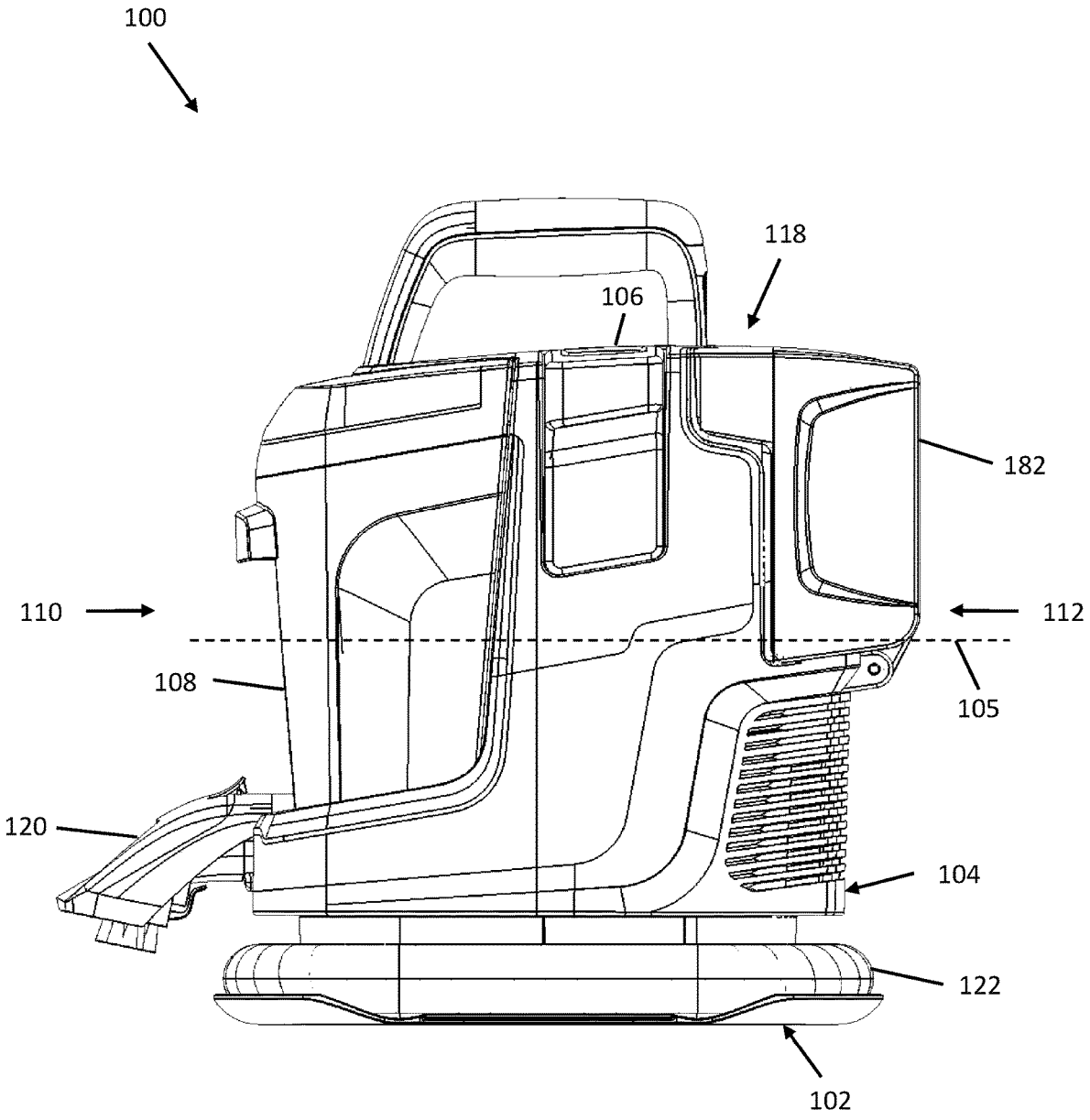
FIG. 3 is a right side elevational view of the portable extraction cleaner of FIG. 1.

Before any embodiments are explained in detail, it is to be understood that the present disclosure is not limited in its application to the details of construction and the arrangement of components set forth in the following description or illustrated in the following drawings. The present disclosure is capable of other embodiments and of being practiced or of being carried out in various ways. It should be understood that the description of specific embodiments is not intended to limit the disclosure from covering all modifications, equivalents and alternatives falling within the spirit and scope of the disclosure as defined in the appended claims. Also, it is to be understood that the phraseology and terminology used herein is for the purpose of description and should not be regarded as limiting.

As used herein, the term "horizontal" or "horizontally" is not limited to a direction or plane that is substantially or approximately parallel to a floor or other support surface on which the portable extractor is sitting, but also refers more generally to an orientation that is more lying over than upright. Similarly, the term "vertical" or "vertically" is not limited to a direction or plane that is substantially or approximately perpendicular to a floor or other support surface on which the portable extractor is sitting, but also refers more generally to an orientation that is more upright than lying over. The terms "top," "bottom," "upper" and "lower" refer to relative positions in a vertical direction. The terms "front" and "rear" refer to relative positions in a horizontal direction along a longitudinal axis of the portable extractor. The term "cleaning liquid" refers to water, a detergent, a sanitizer, or a mixture of water and detergent/sanitizer for cleaning or rinsing.

Referring now to the figures, FIGS. 1-7 illustrates an embodiment of a portable extraction cleaner or extractor 100 having a front side 110, a rear side 112 opposite the front side 110 defining a horizontal longitudinal axis 105 from the front side 110 to the rear side 112, two opposite lateral sides 114 and 116 disposed between the front side 110 and the rear side 112, and a top side 118. The portable extractor 100 is a canister type extractor that is configured to be easily carried and operated by a user to clean a surface. The portable extractor 100 may be adapted to clean a variety of surfaces, such as carpets, upholstery, hardwood floors, tiles, or the like. The illustrated portable extractor 100 distributes or sprays a cleaning liquid onto a surface to be cleaned and then draws the recovered liquid and dirt from the surface via a cleaning tool (as described below).

The portable extractor 100 includes a base 102 and a main housing 104 mounted on top of the base 102. A supply tank 106 for holding a cleaning liquid to be dispensed onto a surface being cleaned and a recovery tank 108 for receiving and storing recovered liquid and dirt drawn up from the surface being cleaned are removably supported by the main housing 104. The recovery tank 108 is arranged at the front side 110 of the portable extractor 100. In the illustrated embodiment, the recovery tank 108 has portions at least partially defining the front side 110 and the top side 118 of the portable extractor 100. More specifically, the recovery tank 108 includes a tank lid 212 at least partially defining the top side 118 of the portable extractor. In addition, the supply tank 106 is arranged rearwardly of the recovery tank 108 at the first lateral side 114 of the portable extractor 100. In the illustrated embodiment, the supply tank 106 has portions at least partially defining at least one of the top side 118 and the first lateral side 114. The portable extractor 100 further includes a battery pack 180 spaced rearwardly of the supply tank 106 and supported by the main housing 104 at the rear side 112 of the extractor opposite the front side 110.

In one embodiment, the main housing 104 is configured to removably support the recovery tank 108 in an upward orientation in which the tank lid 212 at least partially defines the top side 118 of the portable extractor 100. A tank latch 220 is provided in a top portion of the tank lid 212 configured to selectively secure and release the tank lid 212 to the main housing 104 when the recovery tank 108 is supported by the main housing 104.

A cleaning tool 120 is fluidly coupled to the recovery tank 108 via a flexible hose 122 for transporting recovered liquid and dirt drawn up from the surface by the cleaning tool 120 to the recovery tank 108. The cleaning tool 120 is also in fluid communication with the supply tank 106, for example, via a conduit carried in the flexible hose 122, for dispensing cleaning liquid onto the surface to be cleaned. The cleaning tool 120 may be detachably coupled to the main housing 104 at the second lateral side 116 of the portable extractor 100 opposite the first lateral side 114.

With reference to FIGS. 8-11, the base 102 may include a lower base portion 124 coupled to an upper base portion 126. The lower base portion 124 and the upper base portion 126 may be separate components releasably or permanently attached together using fasteners (e.g., screws, bolts, etc.), tabs or hooks. Alternatively, the upper base portion 126 may be integrally formed with the lower base portion 124, or the upper base portion 126 and the lower base portion 124 may be formed together as a unitary body. The lower base portion 124 has a flat bottom surface to support the portable extractor 100 on a floor or other generally flat support surface. The lower base portion 124 includes one or more peripheral flanges or projections 128 formed at least partially along the perimeter of the lower base portion 124 proximate the bottom end of the base 102. The peripheral flanges 128 extend upwardly and outwardly beyond the perimeter of the upper base portion 126 to support one or more portions of the flexible hose 122 when the flexible hose 122 is wrapped around the base 102 for storage. The peripheral flanges 128 may define one or more access recesses 129 between them to facilitate gripping and handling of the flexible hose 122.

Figure 8:
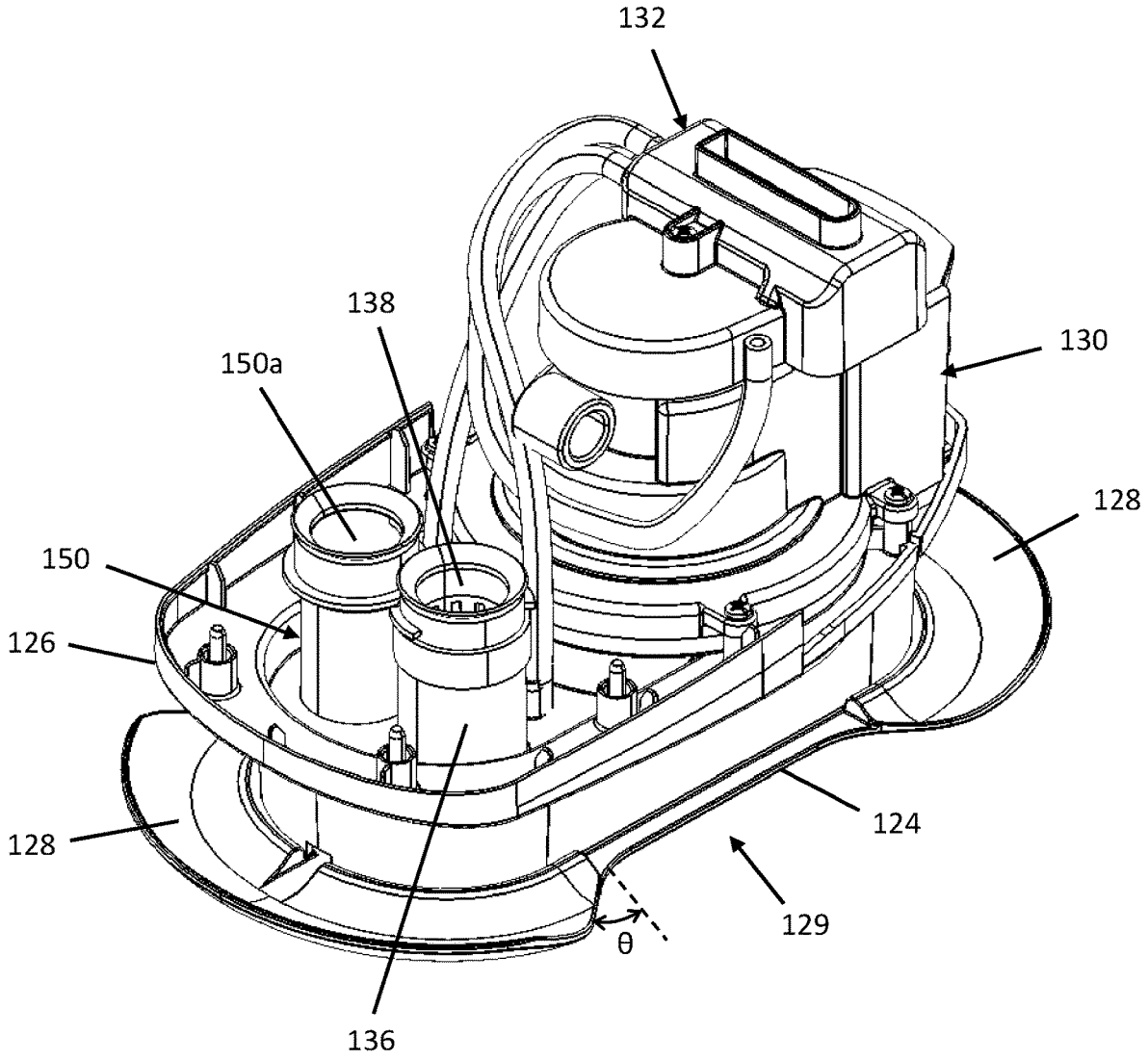
FIG. 8 is a perspective view of the base, suction source and pump assembly of the portable extraction cleaner of FIG. 1.
Figure 9:
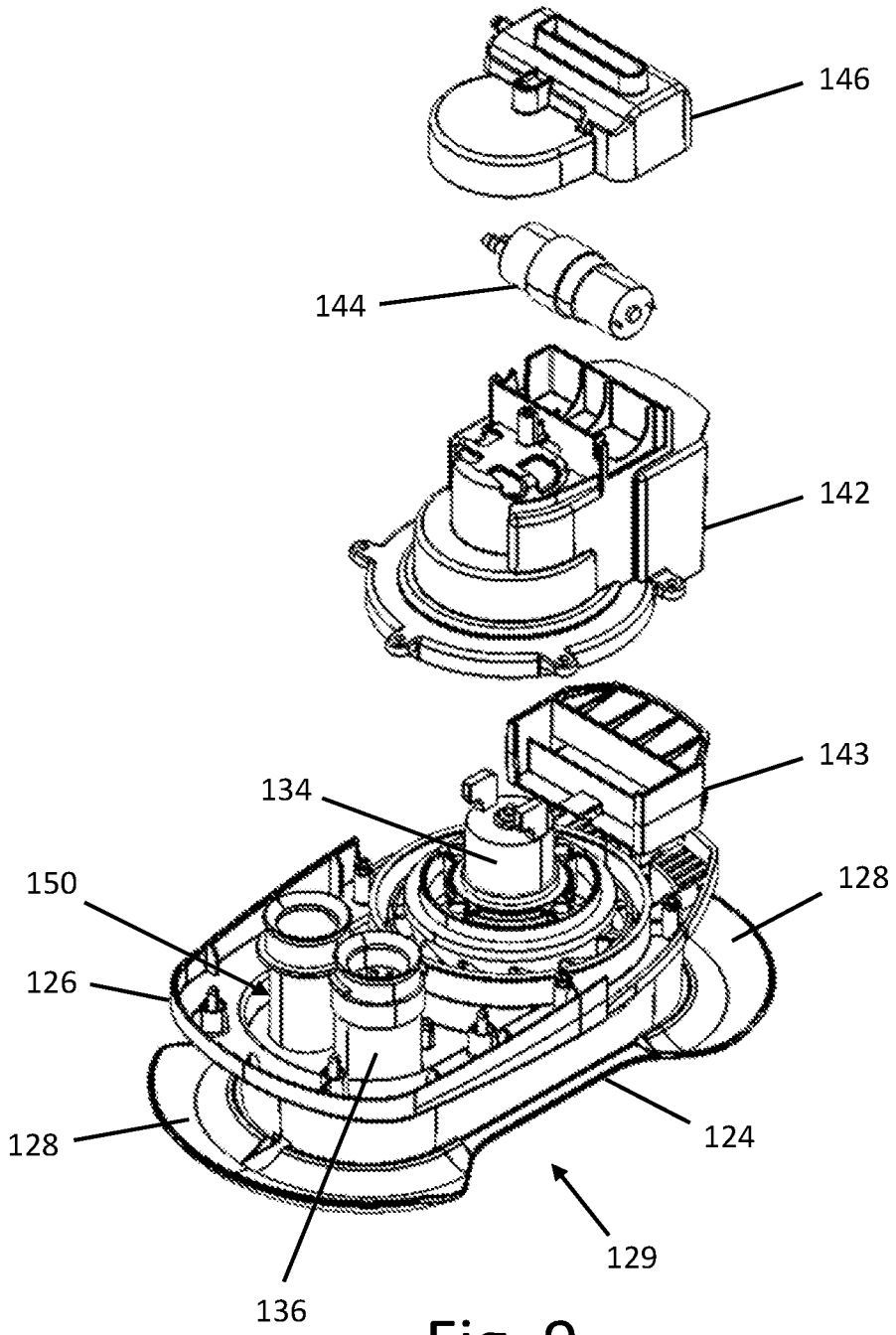
FIG. 9 is a partially exploded perspective view of the base, suction source and pump assembly of the portable extraction cleaner of FIG. 1.

In the illustrated embodiment, a pair of peripheral flanges 128 are provided respectively at the oppositely facing front and rear ends of the lower base portion 124. The illustrated peripheral flanges 128 form a pair of access recesses 129 between them, which are located on opposite sides of the lower base portion 124. Preferably, the sides of the access recesses 129 are beveled to inhibit catching or snagging the flexible hose 122 upon removal from its stored position. In some embodiments, such as shown in FIG. 8, the angle θ of the bevel on the sides of the access recesses 129 may be greater than about 20 degrees, and more preferably may range from about 35 degree to about 55 degrees, and still more preferably may be about 50 degrees.

The upper base portion 126 is configured to support or carry a suction source 130 and a pump assembly 132 thereon. The suction source 130 is in fluid communication with the recovery tank 108 and is operable to draw recovered liquid and dirt from the surface being cleaned through a suction nozzle of the cleaning tool 120 and into the recovery tank 108 via the flexible hose 122. For example, the suction source 130 may include a motor and fan assembly 134 comprising a suction motor that rotates a fan or impeller to generate a suction airflow. In the illustrated embodiment, the suction source 130 is mounted on top of the upper base portion 126 proximate a rear end of the upper base portion 126 and the midpoint of the width of the upper base portion 126. The motor and fan assembly 134 may be arranged in an upright or vertical orientation such that the suction motor and the impeller thereof are aligned vertically and rotate about a common vertical axis. With this arrangement, a portion of the motor and fan assembly 134 is received in a seat 140 that is integrally formed in the top of the upper base portion 126. The seat 140 is generally shaped and sized to match the shape and size of the portion of the motor and fan assembly 134 being received therein. Also, a suction source housing 142 is secured to the upper base portion 126 over the motor and fan assembly 134. The suction source housing 142 is configured to cooperate with the upper base portion 126 to sandwich and securely hold the motor and fan assembly 134 therebetween.

The motor and fan assembly 134 is fluidly coupled to the recovery tank 108 via a working air conduit formed with a suction port 136. The suction port 136 is arranged proximate a front end of the upper base portion 126 and extends upwardly from the upper base portion 126 in generally a vertical orientation to a distal open end 138 to provide a fluid coupling with the recovery tank 108, as described further below. The suction port 136 may be integrally formed with the upper base portion 126 or may be separately formed from the upper base portion 126. The proximal end of the suction port 136 opposite the distal open 138 extends through the upper base portion 126 and is in fluid communication with the motor and fan assembly 134. For example, one or more passages may be formed by partitions or channels defined between the upper base portion 126 and the lower base portion 124 for delivering the working air drawn from the recovery tank 108 via the suction port 136 to the motor and fan assembly 134, where it can be discharged as exhaust. In some embodiments, a baffle 143 (FIG. 9) may be mounted on a shelf formed at the rear end of the upper base portion 126 to direct the exhaust air exiting the motor and fan assembly 134 downwardly through a plurality of slots formed in the shelf and/or rearwardly through vent portions 176 of the housing body 160, described further below.

The pump assembly 132 is in fluid communication with the supply tank 106 and the cleaning tool 120. The pump assembly 132 is operable to draw cleaning liquid from the supply tank 106 and to supply or deliver the cleaning liquid to the cleaning tool 120 where it can be dispensed onto a surface to be cleaned via a distribution nozzle of the cleaning tool 120. The pump assembly 132 may include a pump 144, for example, a DC pump or other suitable pump, and tubing or other conduits fluidly coupling the pump 144 to the supply tank 106 and the cleaning tool 120. In the illustrated embodiment, the pump 144 is mounted on top of the suction source housing 142 above the motor and fan assembly 134. In the illustrated embodiment, the pump 144 is arranged horizontally with its longitudinal pump axis transverse to the front-to-rear longitudinal axis 105 of the portable extractor 100. A pump cover 146 may be secured to the suction source housing 142 over the pump 144 to secure the pump 144 between pump cover 146 and the suction source housing 142. In other embodiments, the suction source 130 and the pump assembly 132 may be positioned elsewhere in the main housing 104.

The pump 144 of the pump assembly 132 is fluidly connected to the cleaning tool 120 via tubing 148 having one or more portions received or carried within or adjacent the flexible hose 122 to deliver cleaning liquid to the surface to be cleaned.

Figure 10:
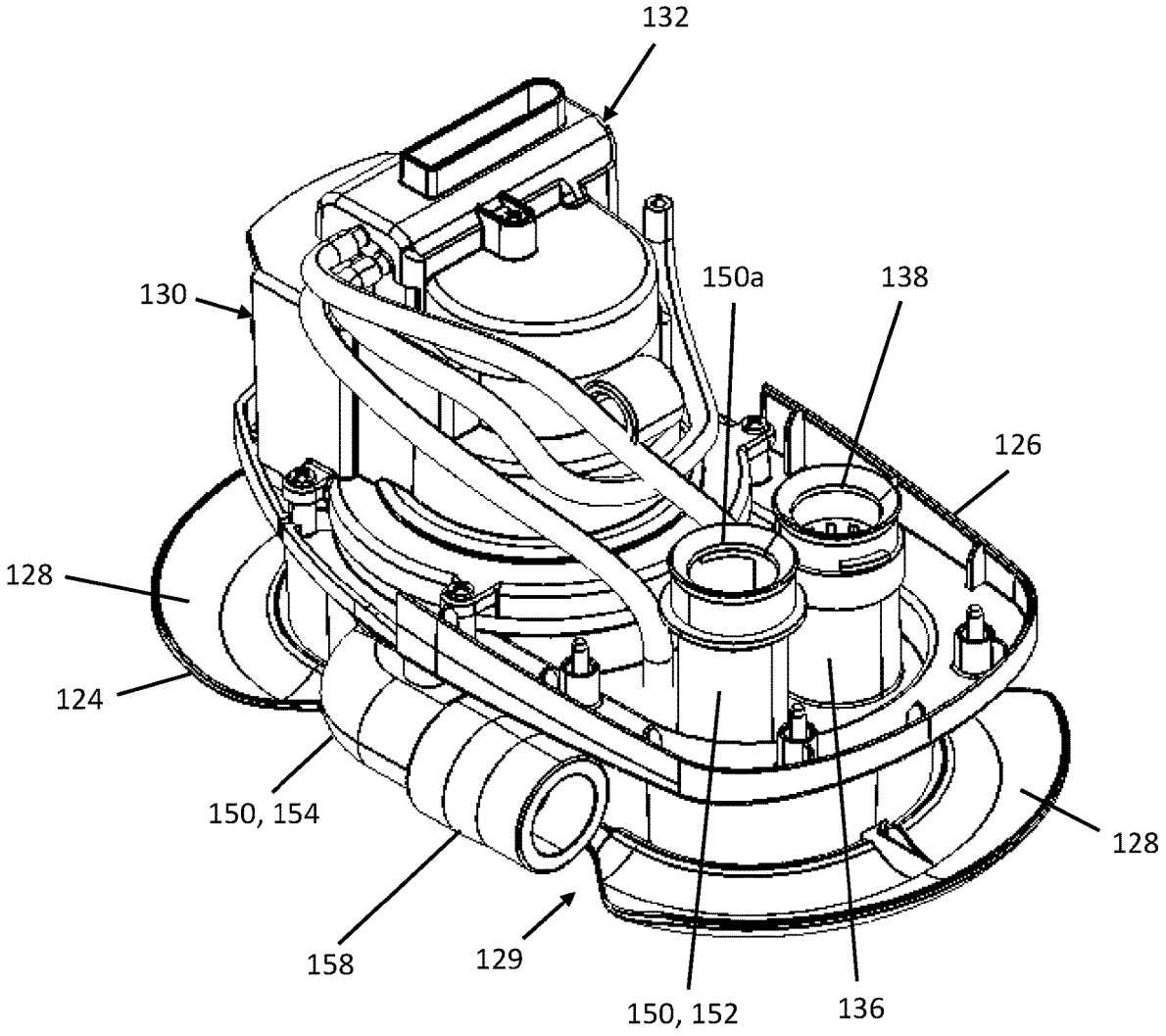
FIG. 10 is yet another perspective view of the portable extraction cleaner of FIG. 1.
Figure 11:
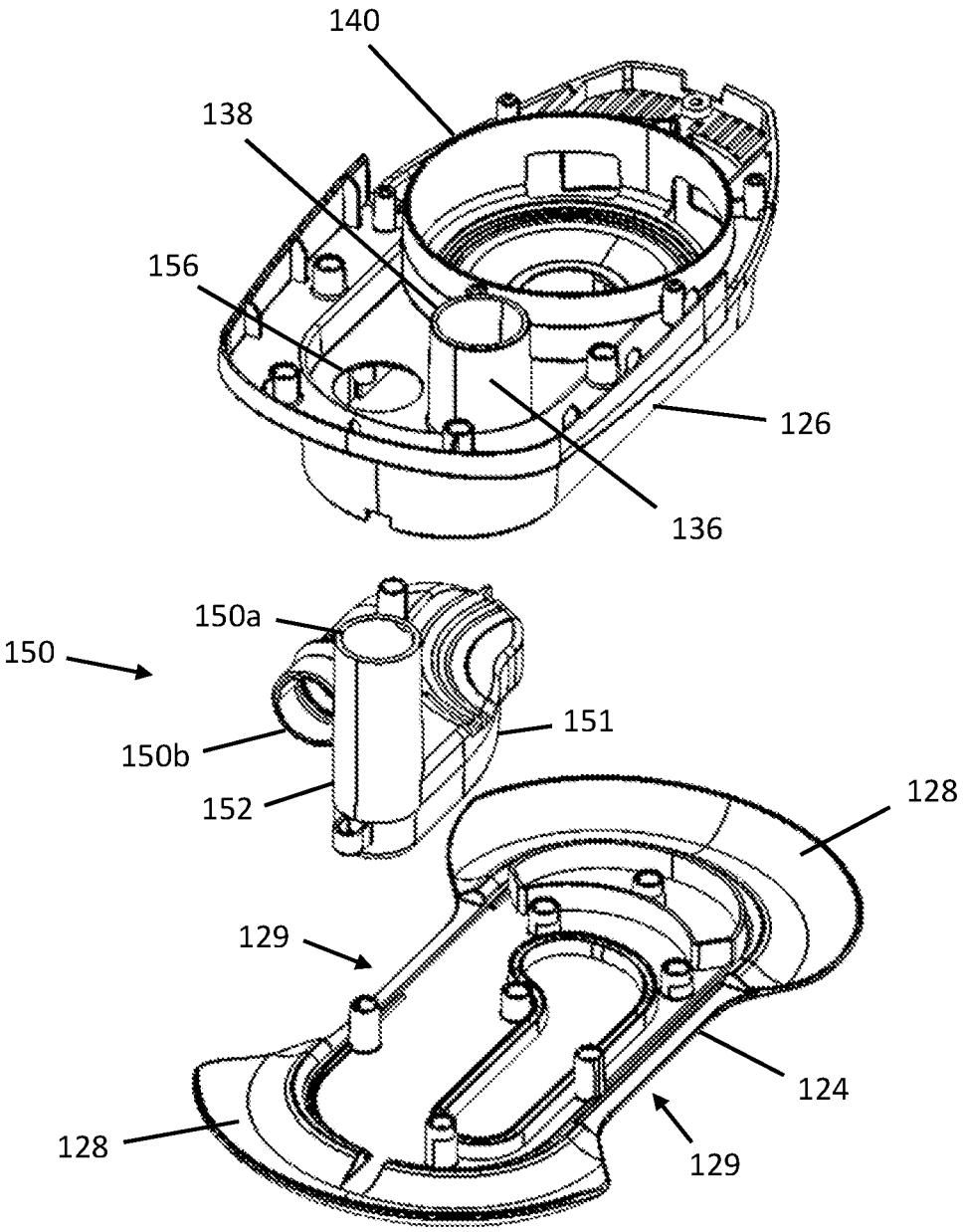
FIG. 11 is a partially exploded perspective view of the base of the portable extraction cleaner of FIG. 1.

In addition, referring to FIGS. 10-11 in particular, a hose connector 150 is provided to fluidly couple the flexible hose 122 to the recovery tank 108 so as to direct recovered liquid and dirt into the recovery tank 108. The hose connector 150 includes a suction conduit 151 connected between a tubular distal section 152 and an elbow-shaped proximal section 154. The suction conduit 151 is fixed between the upper base portion 126 and the lower base portion 124 and may be attached the lower base portion 124 and/or the upper base portion 126 using fasteners (e.g., screws, bolts, etc.), tabs or hooks. In one embodiment, the suction conduit 151 may be formed in part by the lower base portion 124. The tubular distal section 152 of the hose connector 150 extends upwardly from the upper base portion 126 through a hose connector opening 156 formed through the upper base portion 126 proximate the suction port 136. The tubular distal section 152 is oriented vertically and terminates at a distal open end 150*a* of the hose connector 150. The elbow-shaped proximal section 154 of the hose connector 150 exits and from a lateral side of the upper base portion 126 and extends to a proximal open end 150*b* of the hose connector 150 exterior to the upper base portion 126. The proximal open end 150*b* of the hose connector 150 defines a horizontal, longitudinal axis that extends generally along or parallel to the front-to-rear longitudinal axis 105 of the portable extractor 100. The hose connector 150 may be coupled at its proximal open end 150*b* to the flexible hose 122 via a tubular hose cuff 158. With this arrangement, the flexible hose 122 exits the hose cuff 158 in generally a horizontal direction tangentially to the side of the upper base portion 126 so as to facilitate wrapping the hose around the lower base portion 124 on the peripheral flanges 128 of the lower base portion 124 and minimize tension or kinking in the flexible hose 122.

With reference to FIGS. 1-10, the main housing 104 cooperates with the upper base portion 126 to cover, enclose or otherwise house the suction source 130 and the pump assembly 132 and may be attached to the upper base portion 126 in a mating relationship using fasteners (e.g., screws, bolts, etc.), tabs or hooks. The main housing 104 includes a housing body 160 configured to support each of the supply tank 106 and the recovery tank 108 in an upright or vertical orientation as described below.

Figure 12:
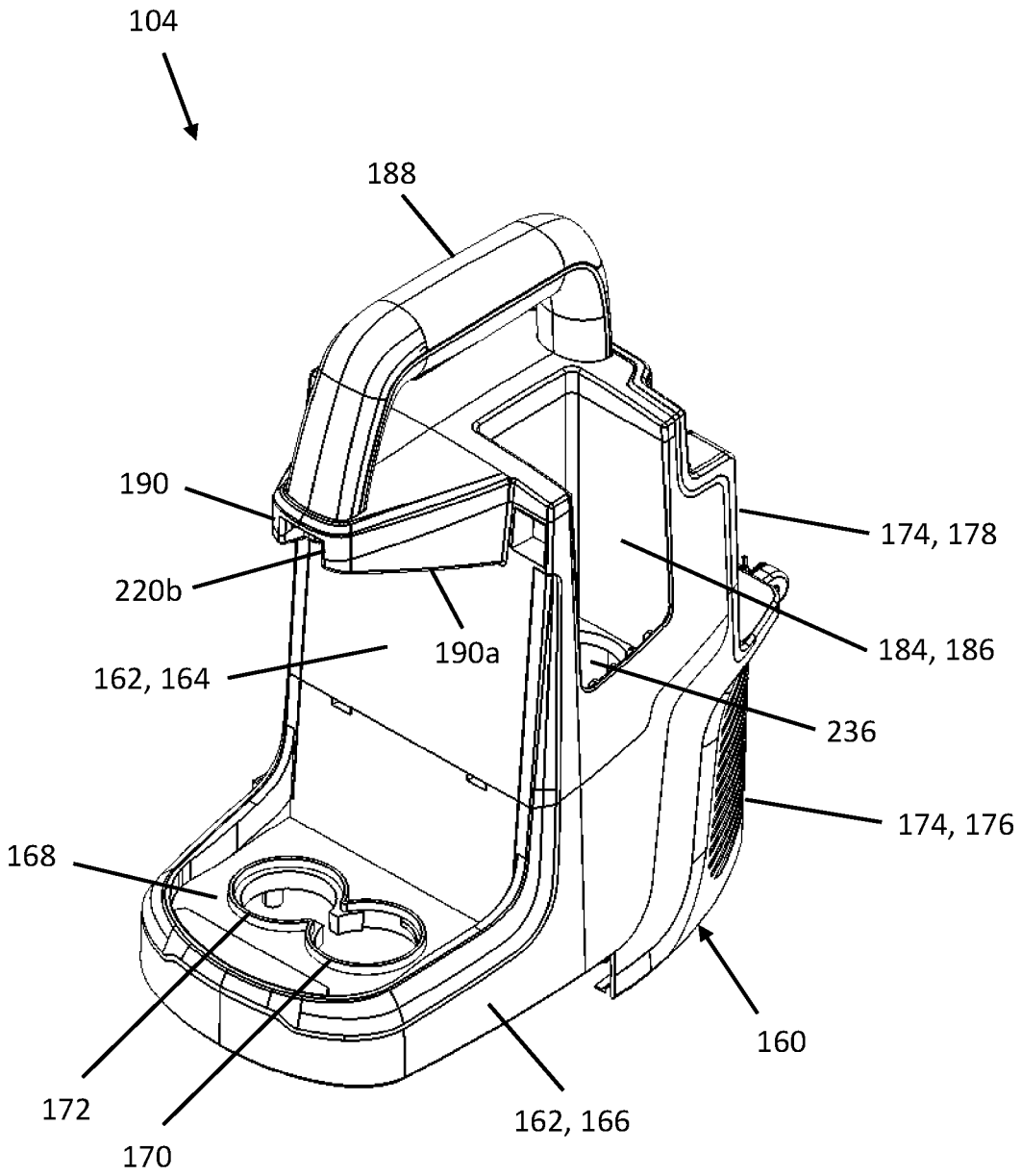
FIG. 12 is a perspective view of the main housing of the portable extraction cleaner of FIG. 1.
Figure 13:
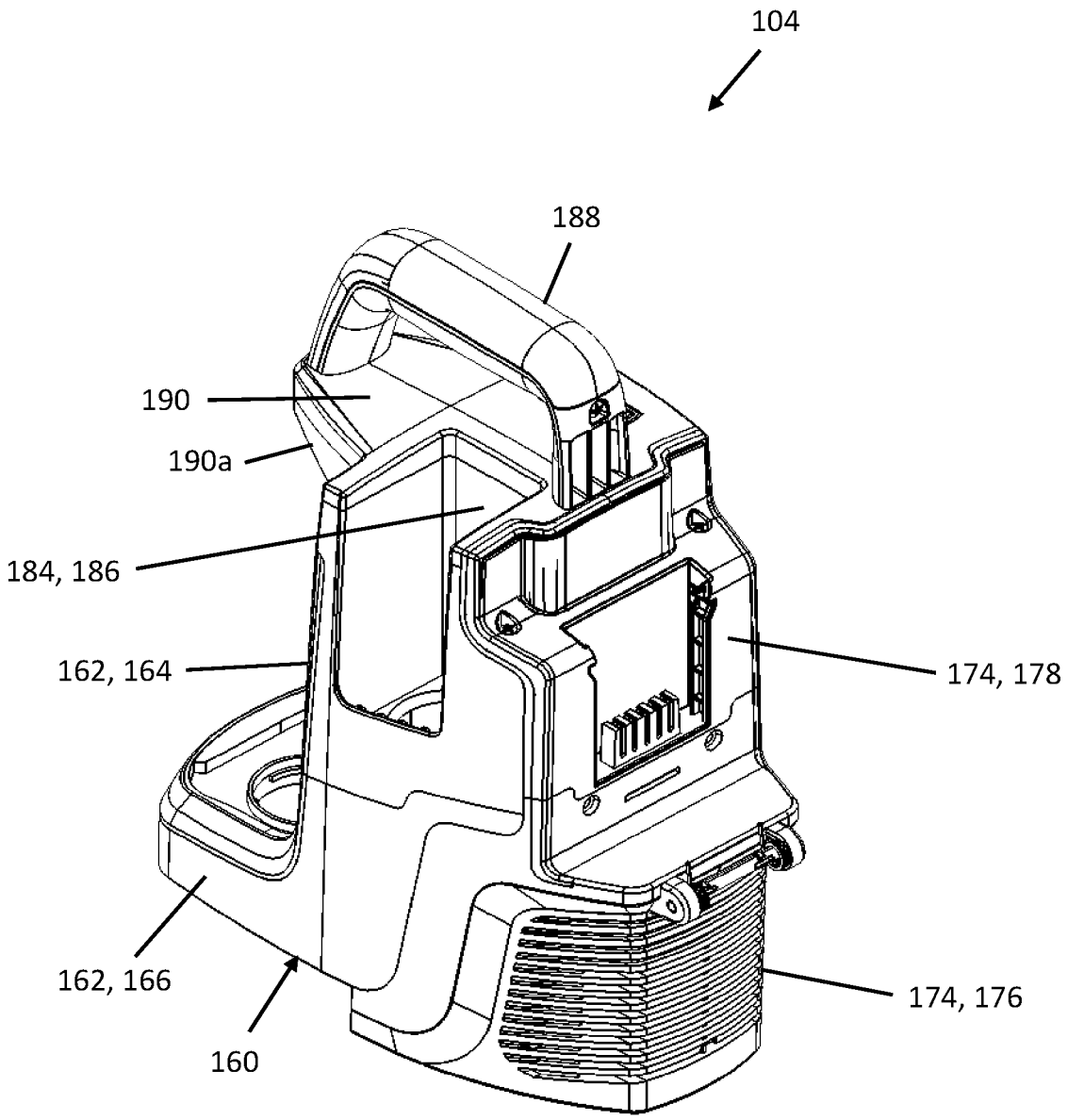
FIG. 13 is yet another perspective view of the main housing of the portable extraction cleaner of FIG. 1.

Referring to FIGS. 12-13, in the illustrated embodiment, the housing body 160 includes a front portion 162 having a reverse L-shaped profile. In particular, the front portion 162 includes a forwardly facing vertical face 164 and an upwardly facing horizontal platform 166 connected to the vertical face 164 at a lower end of the front portion 162. The platform 166 comprises a tank receptacle 168 that in one embodiment is generally shaped and sized to match the shape and size of the bottom end of the recovery tank 108 for removably receiving and supporting the recovery tank 108 thereon in a vertical orientation. When the recovery tank 108 is installed on the platform 166, portions of the recovery tank 108 at least partially define the front side 110 and the top side 118 of the portable extractor 100, as described further below. Two apertures 170, 172 are formed in the tank receptacle 168 and extend through the platform 166. The first aperture 170 receives the distal open end 138 of the suction port 136 for providing fluid communication between the recovery tank 108 and the suction source 130. The second aperture 172 receives the distal open end 150*a* of the hose connector 150 for providing fluid communication between the flexible hose 122 and the recovery tank 108.

The housing body 160 also includes a rear portion 174 arranged opposite the front portion 162. The rear portion 174 defines one or more vent portions 176 for venting the cooling air entering and exiting the suction source 130 and a battery compartment 178. In the illustrated embodiment, a plurality of slot-shaped vent portions 176 are formed symmetrically on opposite sides of the rear portion 174 proximate a lower end of the rear portion 174. Alternatively, the vent portions 176 may have any shape or location relative to the housing body 160 suitable for venting the cooling air entering and exiting the suction source 130.

The battery compartment 178 is configured to removably receive and to support the battery pack 180 at the rear side 112 of the portable extractor 100 opposite the front side 110. The battery pack 180 may include one or more battery cells for supplying power to operate the portable extractor 100, including the suction source 130 and the pump assembly 132. For example, the battery pack 180 may be a rechargeable battery pack 180 having one or more lithium-based cells. In the illustrated embodiment, the battery compartment 178 is formed at an upper end of the rear portion 174 of the housing body 160 and defines a longitudinal battery insertion axis extending in a vertical orientation. Thus, the battery pack 180 may be inserted into the battery compartment 178 along the vertical battery insertion axis. In particular, the battery compartment 178 is open at its top end to removably receive and to support a battery pack 180 in an upright or vertical orientation. The battery compartment 178 may include mating features shaped and configured to releasably engage complimentary features on the battery pack 180 when the battery pack 180 is inserted in the battery compartment 178. When the battery pack 180 is installed in the battery compartment 178, battery contacts on the battery pack 180 come into an electrically conductive connection with corresponding contacts in the battery compartment 178, which are electrically connected to the suction source 130 and the pump assembly 132.

Referring to FIGS. 3-5 and 7, the main housing 104 includes a battery cover 182 to selectively cover and uncover the battery pack 180. In the illustrated embodiment, the battery cover 182 is oriented upright in a closed position to cover the battery pack 180. The lower end of the battery cover 182 is pivotally coupled to the housing body 160 via a hinge joint that allows the battery cover 182 to rotate rearwardly and downwardly into an open position to uncover the battery pack 180. In the illustrated embodiment, when the battery cover 182 is in its upright, closed position, the upper end of the battery cover 182 is substantially flush with the top of housing body 160. The above arrangement for the battery compartment 178 and the battery pack 180 is compact and facilitates easy access and removal of the battery pack 180 using one hand to open the battery cover 182 and slide the battery pack 180 out of the battery compartment 178.

Referring back to FIGS. 12-13, the housing body 160 further includes an intermediate portion 186 coupled between the front portion 162 and the rear portion 174. A recessed supply tank cavity 184 is formed along an upper edge of the housing body 160 in the intermediate portion 186 and is open to a top surface and a side surface of the housing body 160. The recessed supply tank cavity 184 defines a longitudinal supply tank insertion axis extending in generally a vertical direction and its top end forms an insertion opening for inserting the supply tank 106. The supply tank 106 may be inserted into the recessed supply tank cavity 184 along the vertical supply tank insertion axis. With this arrangement, the recessed supply tank cavity 184 is configured to removably receive and support the supply tank 106 therein in an upright or vertical orientation. When the supply tank 106 is installed in the recessed supply tank cavity 184, the supply tank 106 is spaced rearwardly of the recovery tank 108 and portions of the supply tank 106 at least partially define the top side 118 and the first lateral side 114 of the portable extractor 100, as described further below.

A handle 188 is coupled on top of the housing body 160 for carrying the portable extractor 100. The illustrated handle 188 has an elongated shape and extends longitudinally of the housing body 160. More specifically, a horizontal, longitudinal axis of the handle 188 extends generally along or parallel to the front-to-rear longitudinal axis 105 of the portable extractor 100 between the recovery tank 108 and the battery pack 180. The supply tank 106 is located along the side of the handle 188. The handle 188 may be integrally formed with the housing body 160 as a single component or may be separately formed from the housing body 160. In the illustrated embodiment, a first end of the handle 188 is coupled to a top surface of the housing body 160. In the illustrated embodiment, the main housing 104 includes a support member 190, and a second end of the handle 188 opposite the first end is coupled to a top surface of the support member 190. Alternatively, the handle 188 extends transverse to the housing body 160. Specifically, the horizontal, longitudinal axis of the handle 188 may extend across the longitudinal axis 105 of the portable extractor 100.

In the illustrated embodiment, the support member 190 is connected to the vertical face 164 of the front portion 162 of the housing body 160 at an upper end of the front portion 162 and projects forwardly above the platform 166, and may be positioned above the recovery tank 108. The support member 190 may be arranged substantially flush with the top of housing body 160. In one alternative, a display or other user interface is provided on the support member 190 in view of an operator. One or more portions of the support member 190 may be integrally formed with the housing body 160 as a single component or may be separately formed from the rest of the housing body 160. In other embodiments, the handle 188 may have any shape or orientation relative to the housing body 160 and support member 190 and may be coupled to others parts of the housing body 160.

Figure 4:
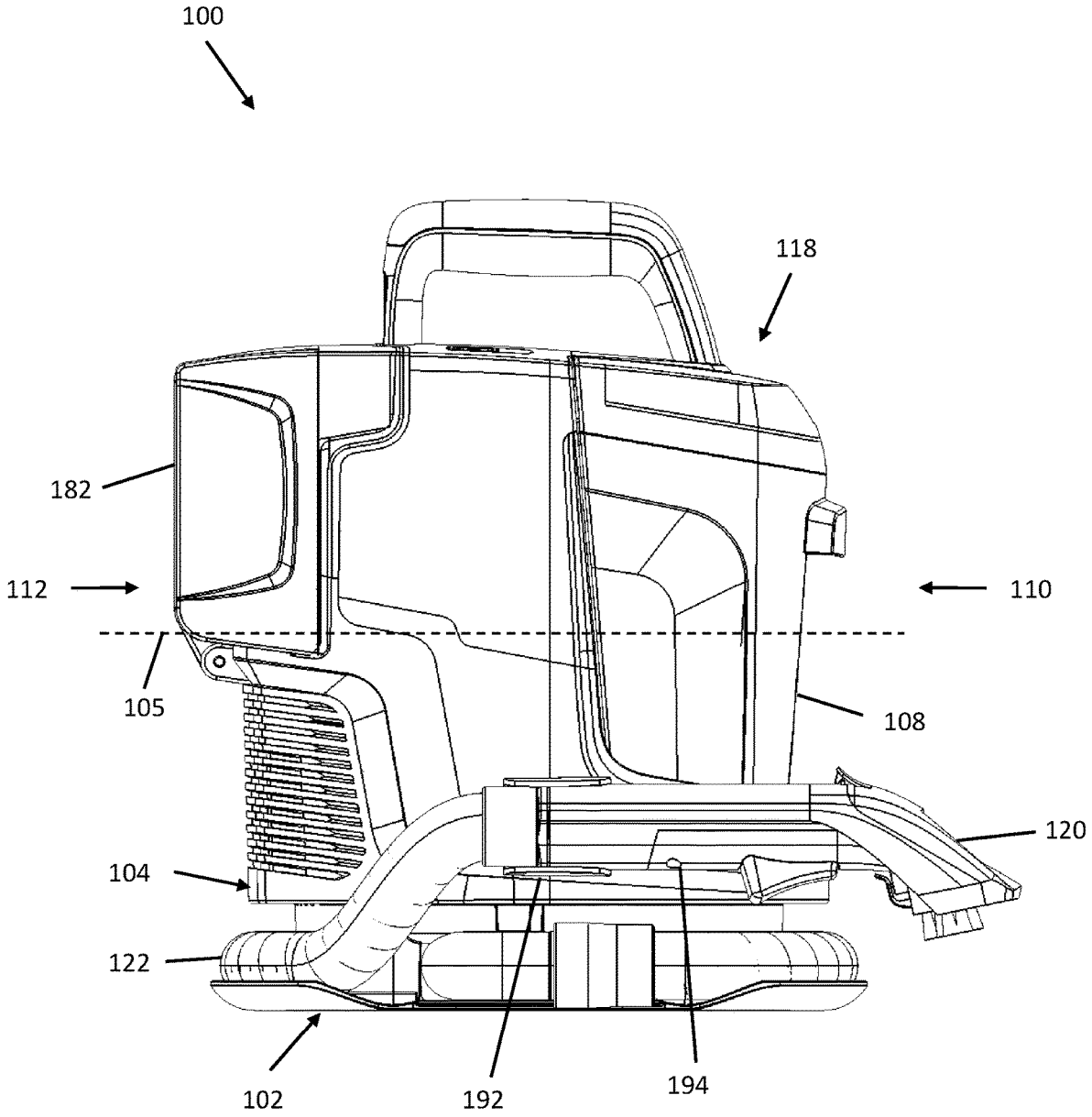
FIG. 4 is a left side elevational view of the portable extraction cleaner of FIG. 1.
Figure 5:
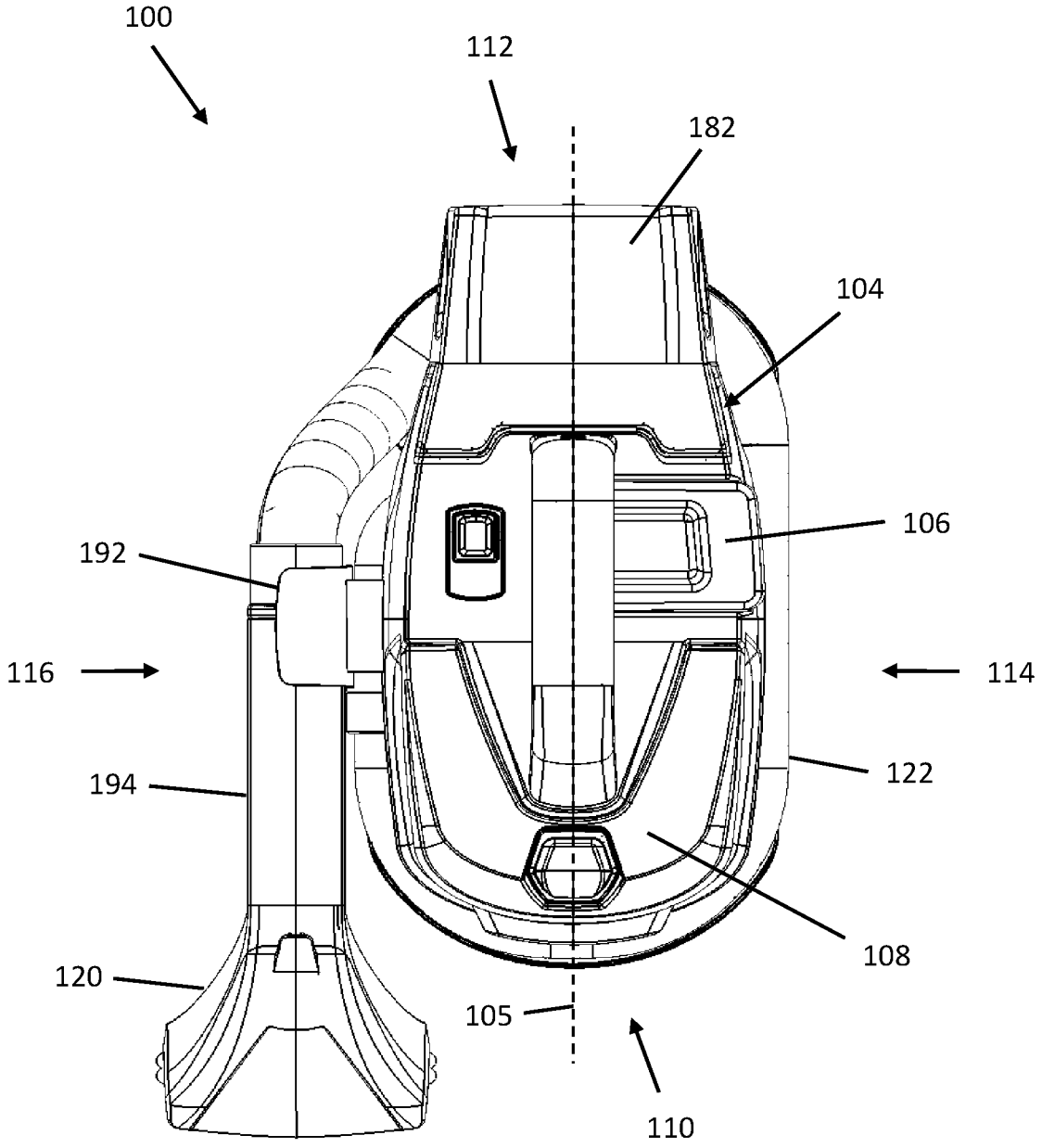
FIG. 5 is a top plan view of the portable extraction cleaner of FIG. 1.
Figure 6:
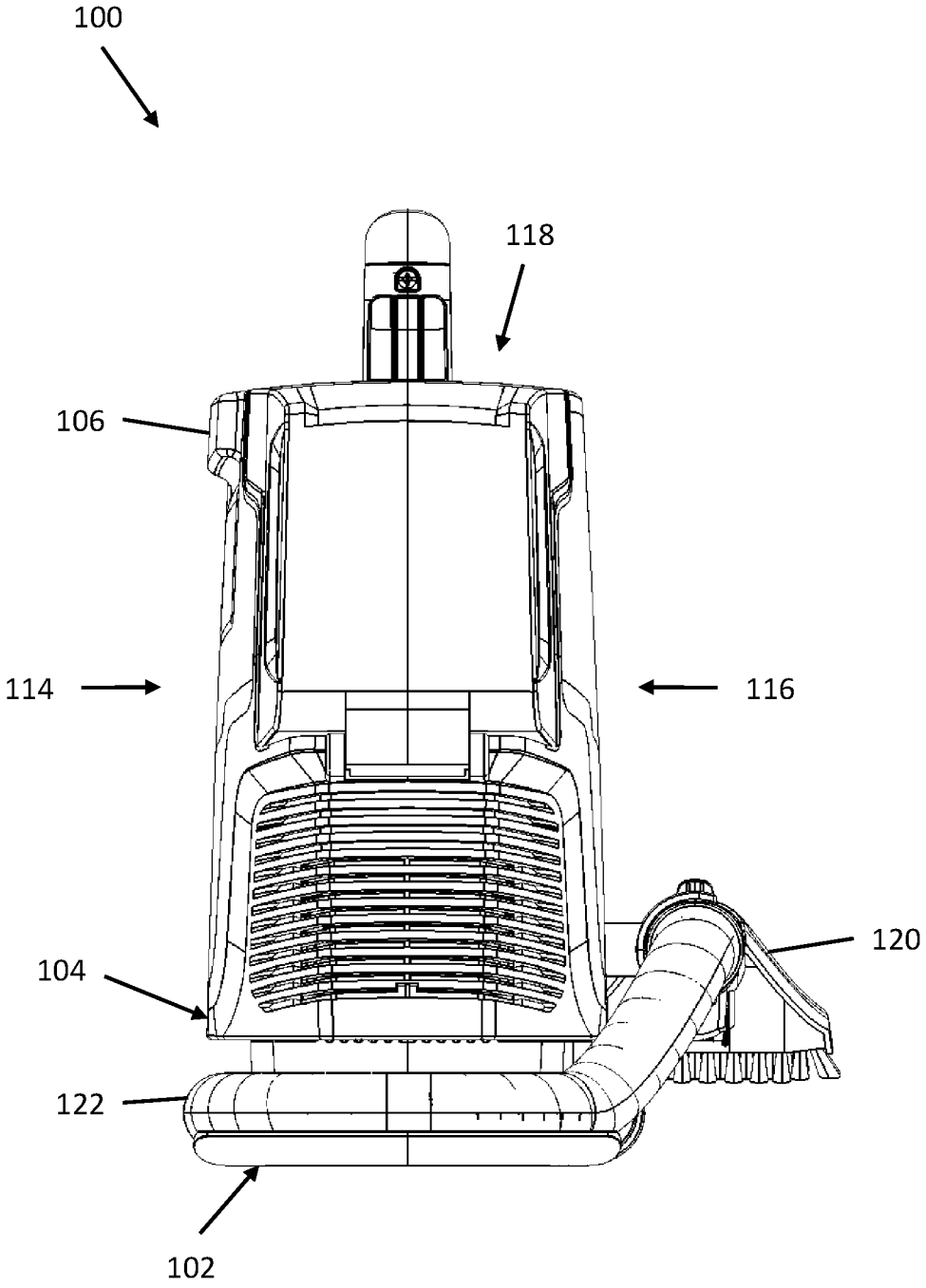
FIG. 6 is a rear side elevational view of the portable extraction cleaner of FIG. 1.
Figure 7:
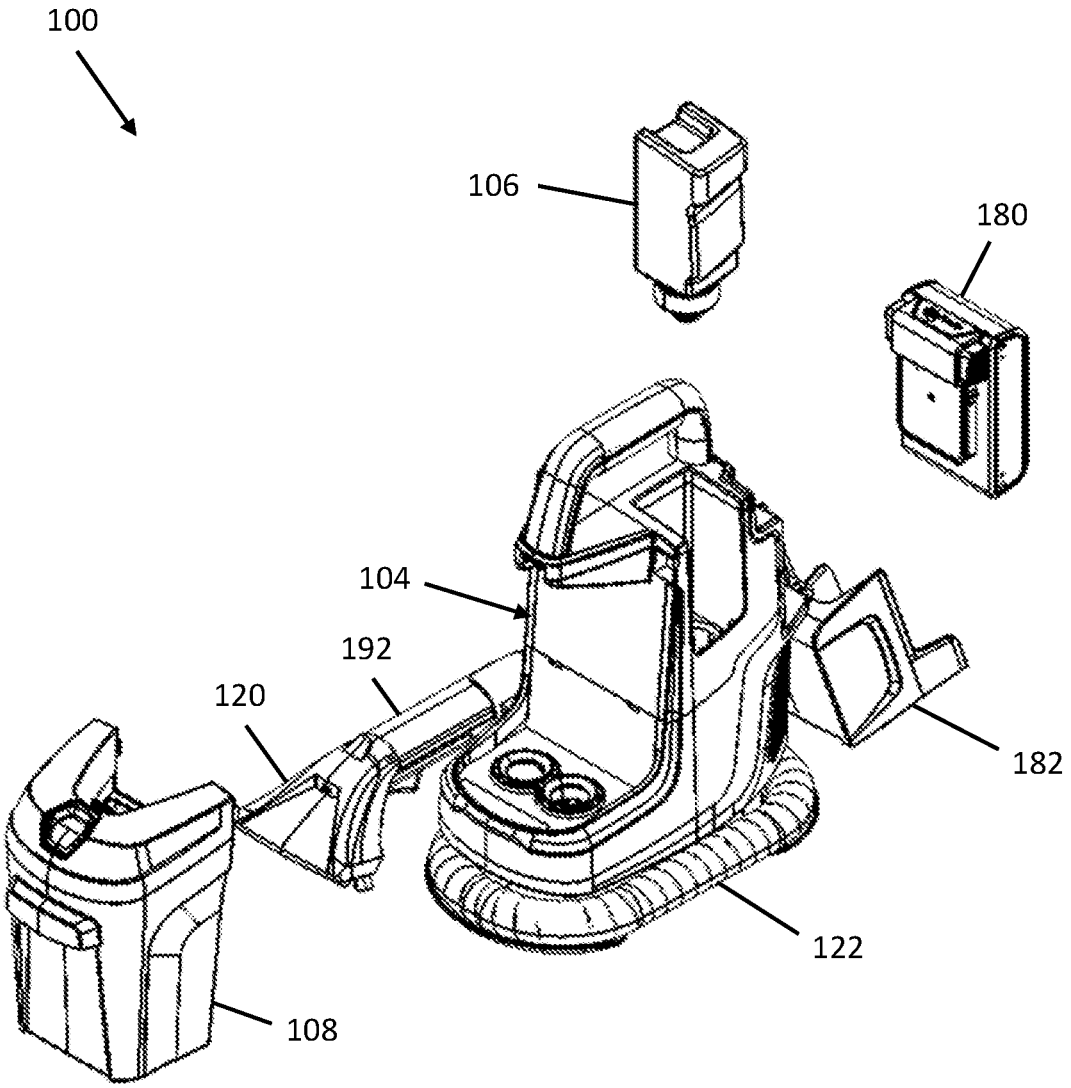
FIG. 7 is a partially exploded perspective view of the portable extraction cleaner of FIG. 1.

In addition, as shown in FIGS. 4-5, a tool holder 192 configured to releasably hold an elongated handle 194 of the cleaning tool 120 is coupled to the housing body 160. The tool holder 192 may be fixed or may rotatable or otherwise adjustable so as to orient the cleaning tool 120 in different directions. In the illustrated embodiment, the tool holder 192 comprises at least one C-shaped support clip having an opening configured to releasably hold the elongated handle 194 of the cleaning tool 120. As shown in FIGS. 4 and 5, the opening of the C-shaped support clip may face a lateral side. Optionally, the opening of the C-shaped support clip may face in an upward direction. The tool holder 192 is coupled on a side of the housing body 160 proximate the bottom end of the housing body 160 such that the opening of the C-shaped clip defines a longitudinal axis oriented in generally a horizontal direction along or parallel to the front-to-rear longitudinal axis 105 of the portable extractor 100. As a result, the elongated handle 194 of the cleaning tool 120 is retained horizontally and tangentially to the side of the housing body 160 by the tool holder 192. This arrangement relieves tension on the end of the flexible hose 122 connected to the elongated handle 194 of the cleaning tool 120 when the hose is wrapped around the upper base portion 126 and provides a convenient compact configuration for storing the portable extractor 100. Alternatively, the tool holder 192 may comprise a magnetic assembly including a magnet coupled to one of the housing body 160 or the elongated handle 194 of the cleaning tool 120 and a ferromagnetic plate coupled to the other of the housing body 160 or the elongated handle 194 of the cleaning tool 120 such that the ferromagnetic plate is attracted to the magnet to releasably hold the cleaning tool 120 in place on the side of the housing body 160.

Figure 14:
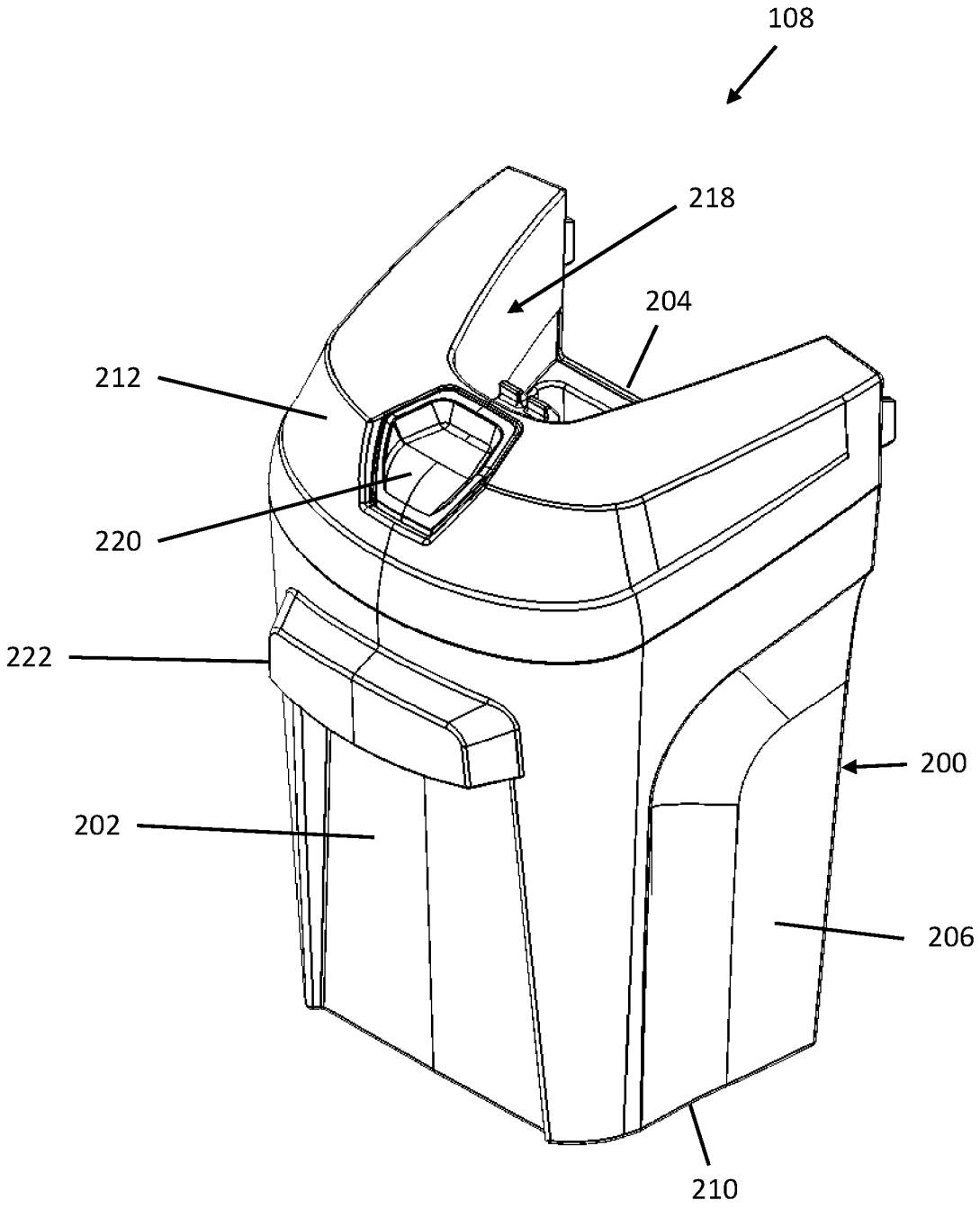
FIG. 14 is a perspective view of the recovery tank of the portable extraction cleaner of FIG. 1.
Figure 15:
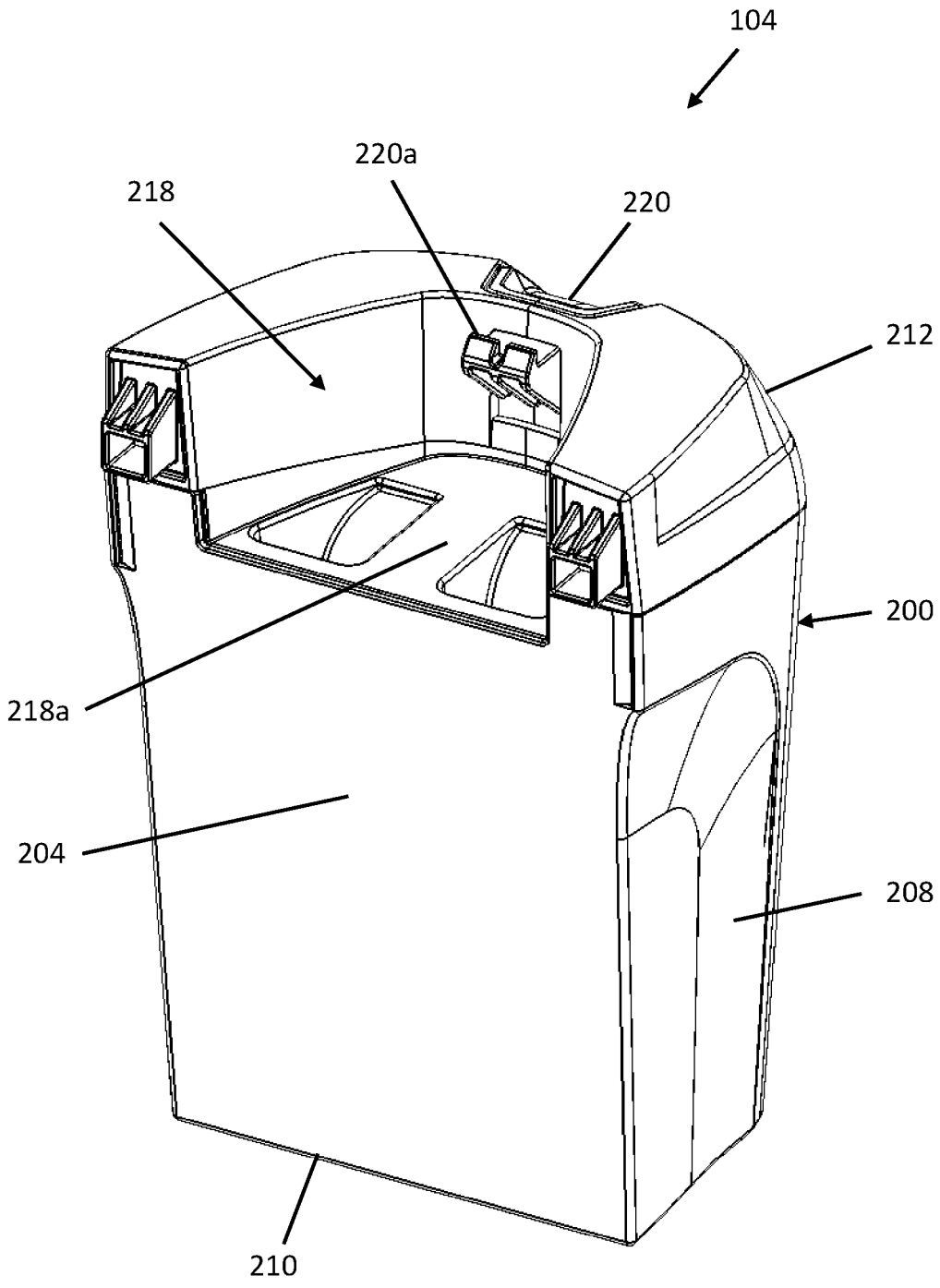
FIG. 15 is yet another perspective view of the recovery tank of the portable extraction cleaner of FIG. 1.
Figure 16:
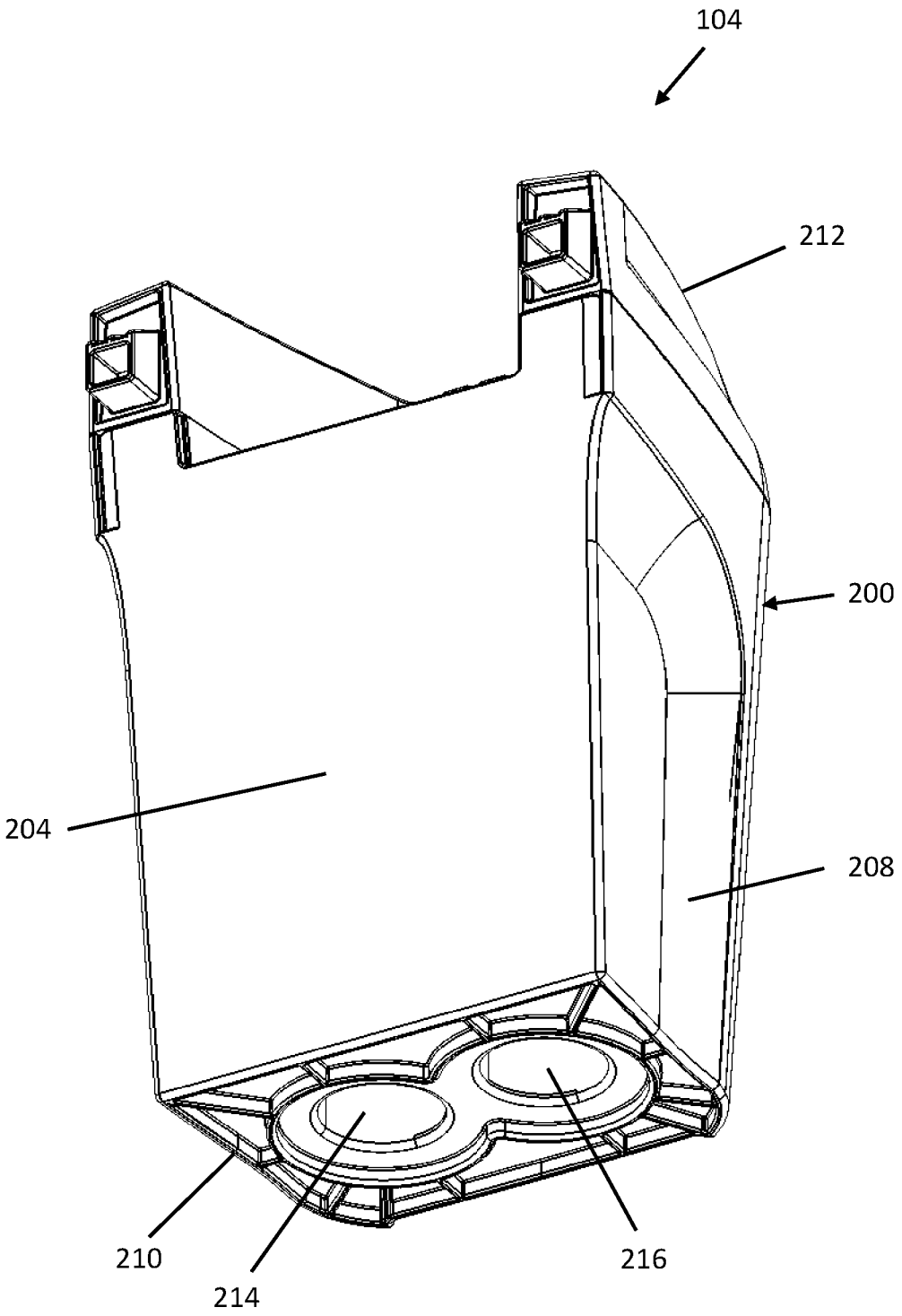
FIG. 16 is yet another perspective view of the recovery tank of the portable extraction cleaner of FIG. 1.

With reference to FIGS. 14-16, the recovery tank 108 comprises a container 200 that defines an internal volume for receiving and storing recovered liquid and dirt drawn up from the surface being cleaned by the suction airflow generated by the suction source 130. The container 200 may be at least partially translucent or transparent to allow the user to easily detect the amount of cleaning fluid and dirt drawn up from the surface being cleaned. The illustrated container 200 includes a front wall 202 and a rear wall 204 connected by a pair of oppositely facing side walls 206 and 208. The front, rear and side walls 202, 204, 206 and 208 are formed integrally with a bottom wall 210 at a closed end of the container 200 that defines the bottom end of the recovery tank 108. The tank lid 212 for covering the container 200 is arranged at the open end of the container 200 opposite the closed end. The tank lid 212 may be removably coupled to the open end of the container 200 to provide access to the internal volume of the container 200 for emptying and cleaning the container 200 once the recovery tank 108 is removed from the main housing 104. For example, the tank lid 212 may have a lower portion or skirt configured to be received in the container 200, and may include a seal disposed around the edges of the lower portion to provide a sealing engagement with the container 200. In this arrangement, the tank lid 212 is axially insertable into and axially removable from the container 200. When the tank lid 212 is coupled to the container 200, the tank lid 212 and the container 200 are secured against lateral movement relative to each other. In an alternative embodiment, the tank lid 212 may be hingedly connected to the container 200.

When the recovery tank 108 is installed on the platform 166 with the rear wall 204 of the container 200 adjacent the vertical face 164 of the front portion 162, the front wall 202 of the container 200 defines at least a portion of the front side 110 of the portable extractor 100, the side walls 206 and 208 of the container 200 define at least a portion of the lateral sides 114 and 116 of the portable extractor 100, and the tank lid 212 defines at least a portion of the top side 118 of the portable extractor 100. The recovery tank 108 is configured to be removable from the main housing 104 as a single unit, including the container 200 and the tank lid 212, as described below.

A rear top portion of the tank lid 212 defines a handle recess area 218 that is open at its top end and its rear end. The handle recess area 218 is configured to receive the support member 190 therein when the recovery tank 108 is installed on the platform 166. Preferably, the support member 190 is received with a clearance fit and the top of the tank lid 212 is substantially flush with the top of the support member 190 and the top of the housing body 160. Also, the handle recess area 218 and the support member 190 may cooperate with each other to provide a tilt clearance area between them to facilitate removing the recovery tank 108 from the main housing 104. In particular, the handle recess area 218 may be provided with an interior bottom surface 218*a* that may be generally flat or planar, and which is oriented in generally a horizontal direction when the recovery tank 108 is installed on the platform 166. A bottom surface 190*a* of the support member 190 is spaced above the handle recess area 218 to provide clearance for the top rear end of the recovery tank 108 when the recovery tank is tilted forwardly. The bottom surface 190*a* of the support member 190 may be inclined from a front end thereof to a rear end thereof. Thus, the bottom surface 190*a* of the support member 190 may be inclined rearwardly relative to the bottom surface 218*a* of the handle recess area 218. This arrangement provides a clearance area for the top rear end of the recovery tank 108 to be tilted away from the main housing 104 when the recovery tank 108 pivots forwardly and downwardly about its forward bottom end into a tilted working position. Once in the tilted working position, the recovery tank 108 can be conveniently lifted out of tank receptacle 168 and removed from the main housing 104.

The tank lid 212 further includes the tank latch 220 that is manually operable to selectively secure and release the recovery tank 108 to the main housing 104. In the illustrated embodiment, the tank latch 220 is provided at a front top portion of the tank lid 212 forwardly of the handle recess area 218. The tank latch 220 may be a spring-loaded push-button type latch having a release button for operating a pawl or other suitable latch actuator 220*a* to engage and disengage a latch engagement member 220*b* coupled to the main housing 104. For example, the latch engagement member 220*b* may be an aperture or a catch, such as a flange or a tab, formed at the front end of the support member 190 or at the second end of the handle 188. In one embodiment, the tank latch forms the only connection between the tank lid 212 and the main housing 104.

With this arrangement, the tank latch 220 secures the tank lid 212 to the support member 190 when the recovery tank 108 is installed on the platform 166. At the same time, the container 200 is held firmly in place between the tank lid 212 and the platform 166 of the housing body 160. As a result, the recovery tank 108 can be secured to the main housing 104 between the support member 190 at the top end of the recovery tank 108 and the platform 166 at the bottom end of the recovery tank 108. In addition, when carrying the portable extractor 100 by grasping the handle 188 with one hand, the position of the tank latch 220 on the tank lid 212 proximate the handle 188 permits a user to release the recovery tank 108 by depressing the tank latch 220 with the thumb of the carrying hand. At the same time, the user can remove the recovery tank 108 as a single unit, including the container 200 and the tank lid 212 which are attached separately to each other, by grasping a recovery tank handle 222 (described below) positioned below the tank latch 220 with the other hand. In the illustrated embodiment, the tank latch 220 does not secure the tank lid 212 to the container 200 when the recovery tank 108 is released from the main housing 104. In one embodiment, the recovery tank is a collection bin having a cover, for example for a dry vacuum or other wet or dry suction cleaner, wherein the cover defines at least a portion of the top side of the portable extractor and the latch connects the cover to the body of the cleaner as disclosed herein.

The recovery tank handle 222 preferably is provided on a front surface of the front wall 202 of the container 200 in order to facilitate removing and carrying the recovery tank 108. The recovery tank handle 222 may be integrally formed with the container 200 as a single component or may be separately formed from the recovery tank 108. In the illustrated embodiment, the recovery tank handle 222 may be a tab or other protrusion integrally formed with the container 200 as a single component so as to define a well or opening into which the fingertips of a user may be inserted to remove the recovery tank 108 from the main housing 104. More preferably, the position of the recovery tank handle 222 on the front wall 202 of the container 200 is below and proximate the tank latch 220 such that a user may remove the recovery tank 108 with one hand by sliding fingers into the finger well defined by the recovery tank handle 222 and depressing the tank latch 220 with the thumb. In other embodiments, the recovery tank handle 222 may be separately formed from the container 200 or coupled to another part of the container 200.

The bottom wall 210 of the container 200 defines an air outlet 214 through which working air is drawn from the recovery tank 108 and a recovery inlet 216 through which recovered liquid and dirt enters the recovery tank 108. Each of the air outlet 214 and the recovery inlet 216 may be in the form of a pipe that extends from a corresponding opening in the bottom wall 210 upwardly into the recovery tank 108. When the recovery tank 108 is installed on the platform 166, the distal open end 138 of the suction port 136 sealingly engages the air outlet 214 of the container 200 to enable fluid communication between the recovery tank 108 and the suction source 130, and the distal open end 150*a* of the hose connector 150 sealingly engages the recovery inlet 216 to enable fluid communication between the hose 122 and the recovery tank 108. For example, a seal may be arranged about each of the distal open end 138 of the suction port 136 and the distal open end 150*a* of the hose connector 150 for sealing against the bottom wall 210 of the container 200.

Figure 17:
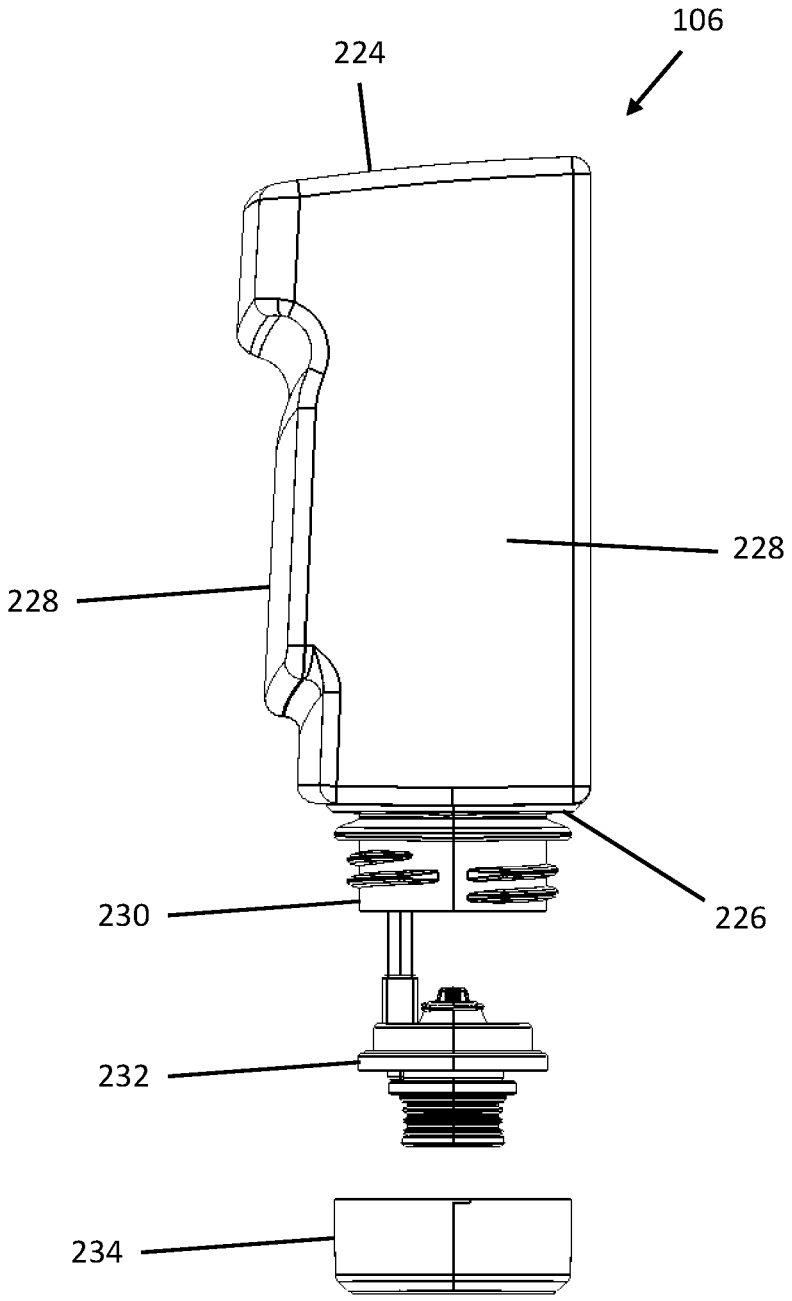
FIG. 17 is a partially exploded view of the supply tank of the portable extraction cleaner of FIG. 1.

With reference to FIG. 17, the supply tank 106 includes a top wall 224, a bottom wall 226 and a sidewall 228 that connects the top and bottom walls 224 and 226. Optionally, the supply tank 106 may be at least partially translucent or transparent to allow the user to easily detect how much cleaning liquid remains in the supply tank 106. The supply tank 106 may be formed in a shape that forms one or more handle areas configured to facilitate removing and handling the supply tank 106 apart from the housing body 160, for example, using protrusions and/or depressions for grasping the supply tank 106. When the supply tank 106 is installed in the recessed supply tank cavity 184 with the bottom wall 226 of the supply tank 106 supported on an interior bottom surface of the recessed supply tank cavity 184, an externally facing portion of the sidewall 228 defines at least a portion of a lateral side 106 of the portable extractor 100 and the top wall 224 of the supply tank 106 defines at least a portion of the top side 118 of the portable extractor 100.

The supply tank 106 includes a cap 234 closing a neck 230 for filling the supply tank. With reference to the illustrated embodiment, the neck 230 may extend from the bottom wall 226 to form a discharge opening of the supply tank 106. The cap 234 may include a release valve 232 to control the flow of cleaning liquid from the supply tank 106. The release valve 232 can have a normally closed configuration to prevent the flow of cleaning liquid out of the supply tank 106 when the supply tank 106 is removed from the recessed supply tank cavity 184. For example, the release valve 232 can be a poppet valve that is closed when the supply tank 106 is removed from the portable extractor 100. In the illustrated embodiment, a portion of the release valve 232 may be matingly received in a socket 236 formed in the bottom surface of the recessed supply tank cavity 184 when the supply tank 106 is installed in the recessed supply tank cavity 184. The socket 236 may be configured to create a sealed connection with the release valve 232 and to form a sealed reservoir that fills with cleaning liquid or clean water flowing through the neck 230 when the release valve 232 is opened. For example, a valve release pin extends axially upward through the socket 236 and aligns with the release valve 232. When the supply tank 106 is installed in the recessed supply tank cavity 184, the valve release pin in the socket 236 (FIG. 12) presses the release valve 232 into an open position. A supply tube exiting from the socket 236 may carry cleaning liquid flowing into the socket 236 from the supply tank 106 to the pump assembly 132.

What is claimed is:

1. A portable extraction cleaner comprising:

a supply tank for holding cleaning liquid;

a recovery tank for receiving and storing recovered liquid and dirt;

a pump in fluid communication with the supply tank and operable to supply cleaning liquid from the supply tank;

a suction source in fluid communication with the recovery tank and operable to draw recovered liquid and dirt into the recovery tank;

a base configured to support the suction source and the pump; and a main housing mounted on the base and housing the suction source and the pump, the main housing configured to removably support the recovery tank and the supply tank, wherein the recovery tank is arranged at a front side of the portable extraction cleaner when supported by main housing, and the supply tank is arranged at a lateral side of the portable extraction cleaner between the front side of the portable extraction cleaner and a rear side of the portable extraction cleaner when supported by main housing.

2. The portable extraction cleaner of claim 1, wherein the main housing includes a housing body that defines a front portion, the front portion has an upwardly facing horizontal platform positioned at a lower end of the front portion, and the recovery tank is removably supported on the platform in a vertical orientation.

3. The portable extraction cleaner of claim 2, further comprising a battery pack electrically connected to the pump and the suction source, wherein the housing body defines a rear portion opposite the front portion, the rear portion defines a battery compartment at an upper end of the rear portion, the battery compartment configured to receive the battery pack along a vertical insertion axis and to support the battery pack in a vertical orientation.

4. The portable extraction cleaner of claim 3, wherein the rear portion defines one or more vent portions for venting cooling air entering and exiting the suction source.

5. The portable extraction cleaner of claim 3, wherein the housing body defines an intermediate portion coupled between the front portion and the rear portion, the intermediate portion defines a supply tank cavity at an upper end of the intermediate portion, the supply tank cavity configured to receive and support the supply tank in a vertical orientation.

6. The portable extraction cleaner of claim 2, wherein the suction source includes a motor and an impeller, wherein the motor is supported on the base in a vertical orientation, and the pump is supported in the housing body above the suction source.

7. The portable extraction cleaner of claim 6, wherein the motor is positioned along a motor axis, and the pump is positioned along a pump axis that has an orientation transverse to the motor axis.

8. The portable extraction cleaner of claim 2, wherein the base includes a tank receptacle having a suction port fluidly coupled to the recovery tank when the recovery tank is supported by the main housing, and the suction source includes a motor and fan assembly fluidly coupled to the recovery tank via the suction port.

9. The portable extraction cleaner of claim 8 further comprising:

a flexible hose for transporting recovered liquid and dirt from a surface to be cleaned to the recovery tank, wherein a proximal end of the flexible hose is fluidly coupled to the suction conduit.

10. The portable extraction cleaner of claim 2 further comprising:

an extractor handle extending along a front-to-rear longitudinal axis of the portable extraction cleaner, the extractor handle having a first end and a second end opposite the first end, wherein the first end of the extractor handle is coupled to a top surface of the housing body and the second end of the extractor handle is coupled to the housing body on a top surface of a support member that projects forwardly at an upper end of the front portion.

11. The portable extractor cleaner of claim 10, wherein the recovery tank is adjacent the first end of the extractor handle, and wherein the supply tank is adjacent a side of the extractor handle.

12. The portable extraction cleaner of claim 1 further comprising:

a cleaning tool in fluid communication with the pump and in fluid communication with the recovery tank; and a tool holder coupled to the main housing or the base and configured to releasably hold the cleaning tool in a storage position with a longitudinal axis of the cleaning tool oriented in a horizontal direction along a front-to-rear longitudinal axis of the portable extraction cleaner.

13. The portable extraction cleaner of claim 1 further comprising:

a cleaning tool;

a flexible hose fluidly coupling the cleaning tool to the recovery tank for transporting recovered liquid and dirt from the cleaning tool to the recovery tank; and a conduit fluidly coupling the cleaning tool to the supply tank for delivering cleaning liquid from the supply tank to the cleaning tool, the conduit having one or more portions carried within the flexible hose.

14. The portable extraction cleaner of claim 1 further comprising:

a flexible hose for transporting recovered liquid and dirt from a cleaning tool to the recovery tank, wherein the base includes one or more peripheral flanges disposed along a perimeter of the base proximate a bottom end of the base, the peripheral flanges configured to support one or more portions of the flexible hose when the flexible hose is wrapped around the base proximate the bottom end of the base.

15. The portable extraction cleaner of claim 14, wherein the one of more peripheral flanges include a plurality of peripheral flanges that define one or more access recesses between them, the one or more access recesses having beveled sides with a bevel angle greater than about 20 degrees.

16. The portable extraction cleaner of claim 1, further comprising a battery pack electrically connected to the pump and the suction source, wherein the main housing includes a housing body that defines a rear portion, and the rear portion defines a battery compartment at an upper end of the rear portion, the battery compartment configured to receive the battery pack along a vertical insertion axis and to support the battery pack in a vertical orientation.

* * * * *